US007640991B2

(12) United States Patent
Leising

(10) Patent No.: US 7,640,991 B2
(45) Date of Patent: Jan. 5, 2010

(54) DOWNHOLE TOOL ACTUATION APPARATUS AND METHOD

(75) Inventor: Lawrence J. Leising, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 131 days.

(21) Appl. No.: 11/469,303

(22) Filed: Aug. 31, 2006

(65) Prior Publication Data

US 2007/0062706 A1 Mar. 22, 2007

Related U.S. Application Data

(60) Provisional application No. 60/718,807, filed on Sep. 20, 2005.

(51) Int. Cl.
*E21B 23/00* (2006.01)

(52) U.S. Cl. ..... 166/373; 166/318

(58) Field of Classification Search ..... 166/373, 166/381, 328, 329, 318
See application file for complete search history.

(56) References Cited

U.S. PATENT DOCUMENTS

| | | | | | |
|---|---|---|---|---|---|
| 1,258,418 | A | * | 3/1918 | Kemble | 417/172 |
| 1,712,948 | A | * | 5/1929 | Burch | 166/328 |
| 1,998,833 | A | * | 4/1935 | Crowell | 166/194 |
| 2,153,034 | A | * | 4/1939 | Baker | 166/194 |
| 2,320,670 | A | * | 6/1943 | Scaramucci | 166/328 |
| 2,737,244 | A | * | 3/1956 | Baker et al. | 166/124 |
| 2,799,349 | A | * | 7/1957 | Clark, Jr. | 166/320 |
| 2,825,412 | A | * | 3/1958 | Standridge | 166/193 |
| 3,062,296 | A | * | 11/1962 | Brown | 166/320 |
| 3,130,783 | A | * | 4/1964 | Orr | 166/284 |
| 3,867,985 | A | * | 2/1975 | Wilkinson | 166/329 |
| 4,258,801 | A | * | 3/1981 | Poston | 175/65 |
| 4,266,605 | A | * | 5/1981 | LaBorde et al. | 166/97.1 |
| 4,341,272 | A | | 7/1982 | Marshall | |
| 4,427,062 | A | * | 1/1984 | Tower | 166/113 |
| 4,574,894 | A | | 3/1986 | Jadwin | |
| 4,694,855 | A | * | 9/1987 | Cunningham | 137/519.5 |
| 4,834,620 | A | * | 5/1989 | Sweeney | 417/53 |
| 4,889,199 | A | | 12/1989 | Lee | |
| 4,893,678 | A | | 1/1990 | Stokley et al. | |
| 5,332,045 | A | | 7/1994 | Ross et al. | |
| 5,392,862 | A | | 2/1995 | Swearingen | |
| 5,396,953 | A | | 3/1995 | Holder et al. | |
| 5,494,107 | A | * | 2/1996 | Bode | 166/285 |
| 5,593,292 | A | * | 1/1997 | Ivey | 417/554 |
| 5,673,751 | A | * | 10/1997 | Head et al. | 166/155 |
| 5,695,009 | A | | 12/1997 | Hipp | |
| 5,730,222 | A | | 3/1998 | Rike, Jr. | |
| 5,999,687 | A | | 12/1999 | Abraham et al. | |
| 6,283,148 | B1 | * | 9/2001 | Spears et al. | 137/533.11 |
| 6,431,270 | B1 | * | 8/2002 | Angle | 166/66.5 |
| 6,776,240 | B2 | * | 8/2004 | Kenison et al. | 166/330 |
| 7,069,997 | B2 | * | 7/2006 | Coyes et al. | 166/328 |
| 7,331,397 | B1 | * | 2/2008 | Wagley et al. | 166/372 |
| 7,533,728 | B2 | * | 5/2009 | Winslow et al. | 166/318 |

* cited by examiner

*Primary Examiner*—Shane Bomar
(74) *Attorney, Agent, or Firm*—Michael Flynn; David Cate; Robin Nava

(57) ABSTRACT

The present invention provides a ball seat apparatus for actuating a downhole component. The ball drop apparatus comprises a plurality of ball seat bores and at least one passage extending therethrough.

15 Claims, 7 Drawing Sheets

DOWNHOLE TOOL ACTUATION APPARATUS AND METHOD

CROSS-REFERENCE TO RELATED APPLICATION

This application claims the benefit of provisional application U.S. Ser. No. 60/718,807 filed Sep. 20, 2005, incorporated by reference herein.

BACKGROUND

The present invention relates to a ball drop apparatus and method. More specifically, the present invention relates to a ball drop apparatus and method for performing downhole operations.

In the downhole environment, ball drop activation devices are used in a variety of applications, including, but not limited to, disconnects, circulation valves, reversing valves, impacting or jarring tools, inflatable packers, etc. With a ball drop apparatus, a ball is dropped and/or pumped through a wellbore tubular to actuate a downhole tool or component. After the ball is seated on a landing seat, typically formed in a bore of a ball seat body, hydraulic pressure can be applied to operate the tool mechanism.

When a ball drop apparatus is utilized as a coiled tubing disconnect, for example, a ball drop disconnect is robust with few accidental disconnects and reliable when needed. A ball drop apparatus is not typically run with wireline disposed inside the coiled tubing. A large diameter ball, and resulting large diameter ball seat bore, is required to form an adequate passage for fluid flowing through the coiled tubing. A large diameter ball can become stuck in the bore of coiled tubing. If small diameter balls are used, as they are typically easier to circulate, the required small diameter ball landing seat can impede fluid flow, increasing the velocity of flow through the seat making it more susceptible to erosion of the ball seat.

There exists, therefore, a need for an improved ball drop tool-activation device.

SUMMARY OF THE INVENTION

An embodiment of the present invention provides a ball seat apparatus for actuating a downhole component. The ball drop apparatus comprises a plurality of ball seat bores and at least one passage extending therethrough.

Another embodiment of the present invention provides a method of actuating a downhole component with a ball drop apparatus. The method comprises the steps of: conveying the ball drop apparatus comprising a body with at least one ball seat bore and at least one passageway extending therethrough; introducing the at least one ball into the ball drop apparatus; and seating a ball into the at least one ball seat bore.

DETAILED DESCRIPTION OF THE INVENTION

Figure 1:
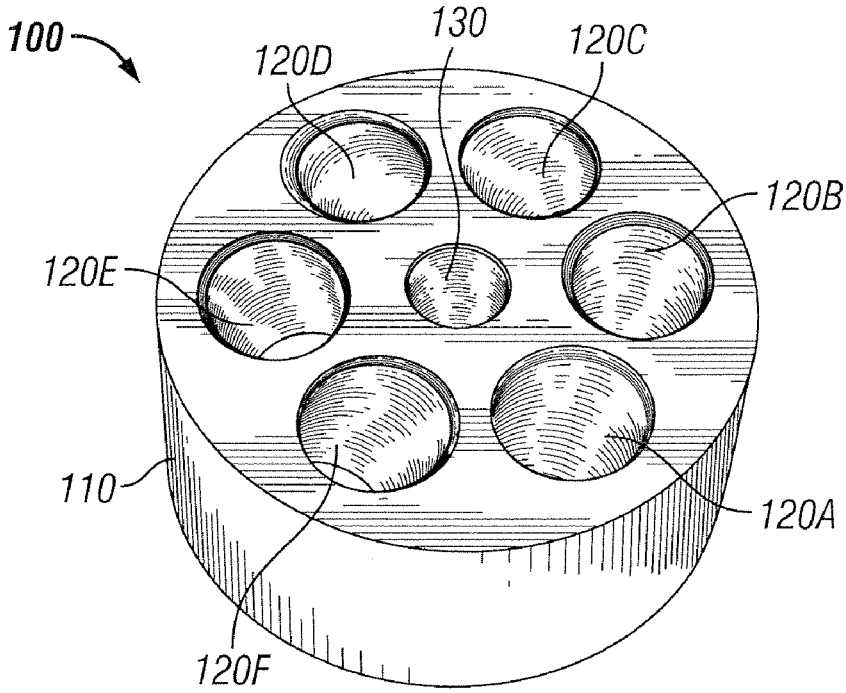
FIG. 1 is a perspective view of a ball seat body of a ball drop apparatus having a plurality of ball seat bores formed therein, according to one embodiment of the invention.

One embodiment of a ball seat 100 having multiple ball seat bores (120A-120F) formed in a body 110 is illustrated in FIG. 1. Multiple ball seat bores (120A-120F) are shown formed in a cylindrical body 110, however the invention is not so limited as a ball seat bore (120A-120F) can be formed in any type of body. Ball seat 100 can be formed unitary to a ball drop apparatus and does not have to be a separate member as shown.

Figure 9:
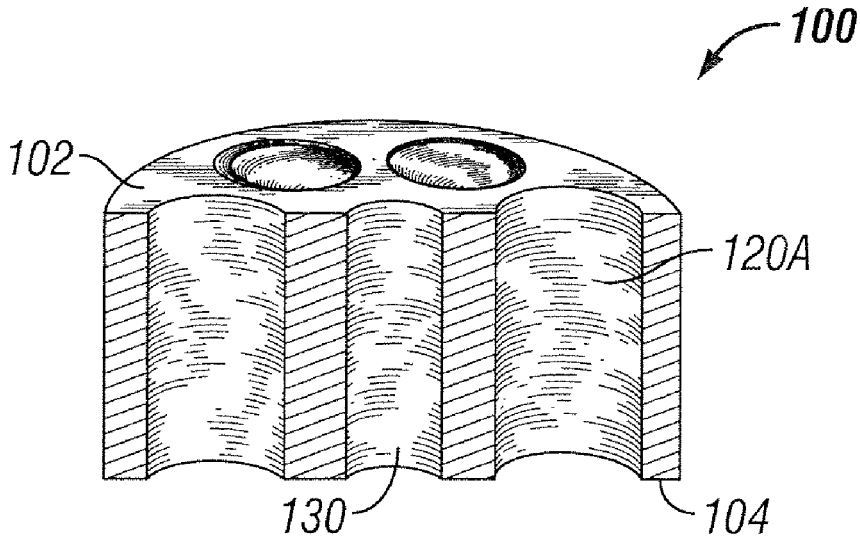
FIG. 9 is a cross-sectional view of the ball seat body having non-angled ball seat bores.

In the embodiment illustrated in FIG. 1, the ball seat bores (120A-120F) are angled tangentially to create vorticity to prevent the balls from stagnating. In addition to the tangential angle, the illustrated embodiment further comprises an inward angle. It should be understood that in alternate embodiments, depending upon the tool orientation, environment, etc., it may not be necessary for the ball seat bores to have either of the tangential or inward angles (FIG. 9). It should be further understood that in some embodiments one or more of the ball seat bores may have tangential or inward angle components while one or more other ball seat bores do not.

Figure 2:
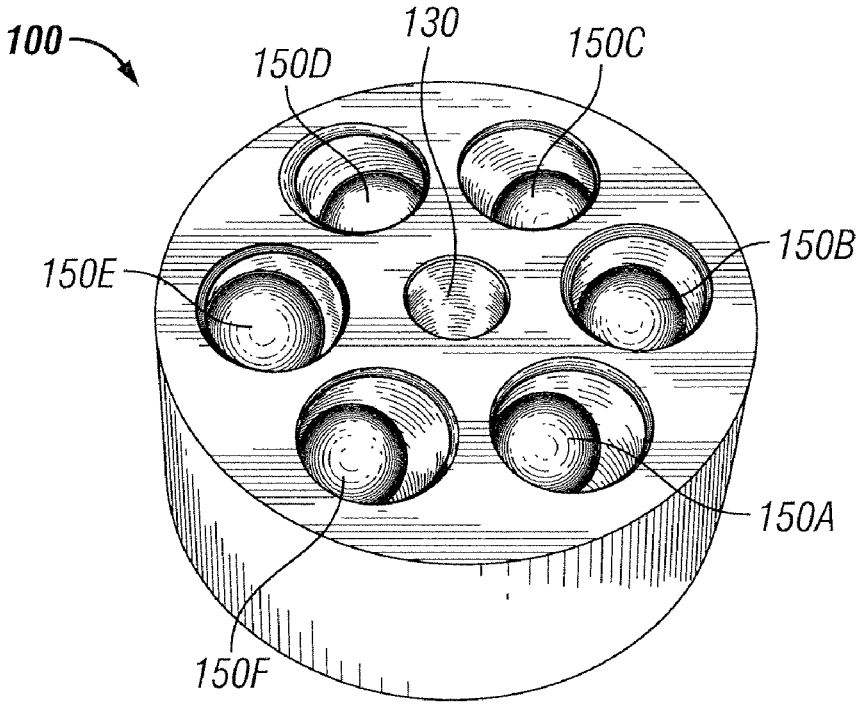
FIG. 2 is a perspective view of the body of FIG. 1, with a ball seated in each of the ball seat bores.
Figure 10:
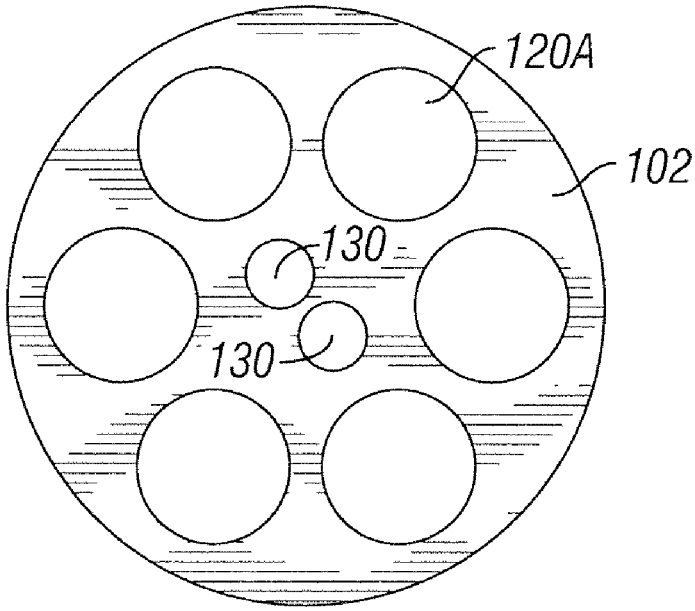
FIG. 10 is a perspective proximal end view of a body having a plurality of passageways formed therein, according to one embodiment of the invention.

FIG. 2 illustrates a plurality of balls (150A-150F) seated in each respective ball seat bore (120A-120F). Preferably any ball (150A-150F) can seat in any of the ball seat bores (120A-120F) in ball seat 100, so that selective insertion is not required. Longitudinal passage 130 in ball seat 100 also extends through body 110 to allow passage of a communication line (such as one or more optical fibers), wireline, slickline, downhole tools, etc., through the ball seat body. It should be understood that in alternate embodiments, such as illustrated in FIG. 10, there may be more than one longitudinal passage 130 extending therethrough the ball seat 100.

Figure 3:
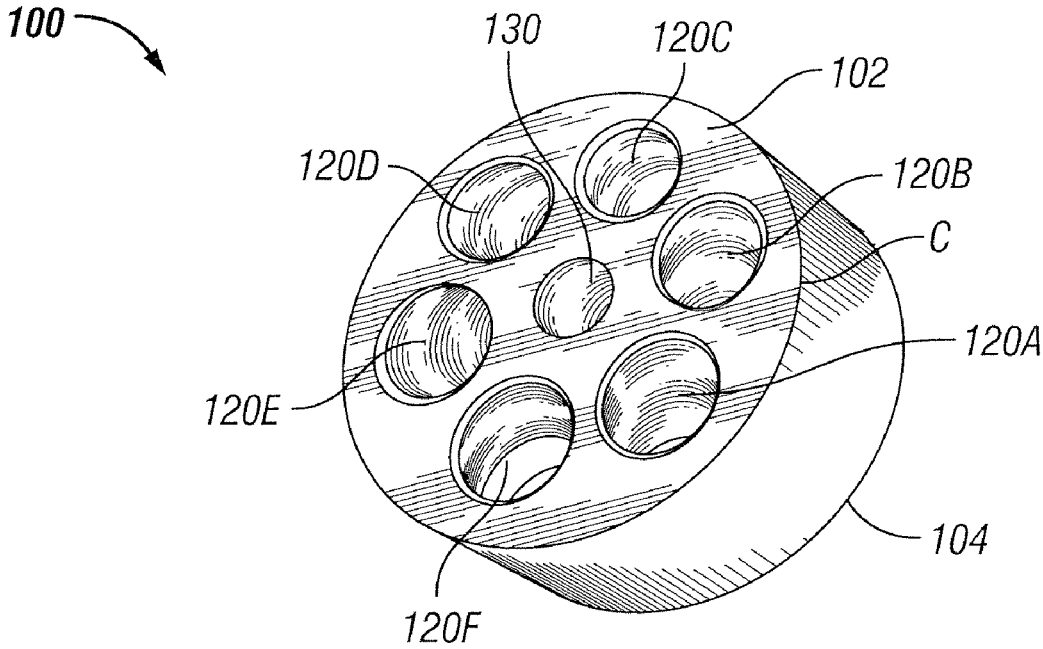
FIG. 3 is a second perspective view of a body having a plurality of ball seat bores formed therein, according to one embodiment of the invention.
Figure 8:
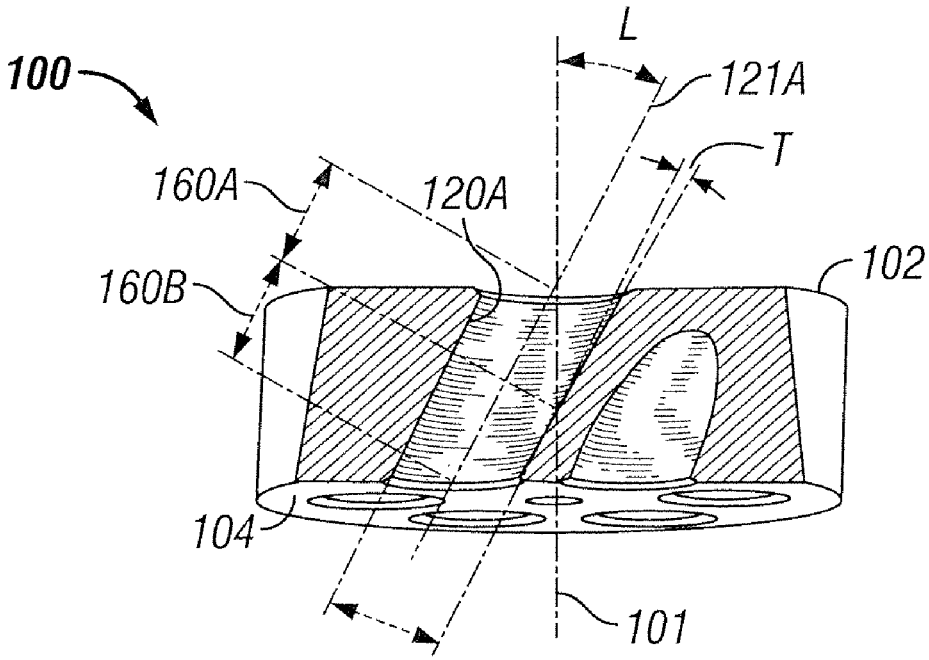
FIG. 8 is a cross-sectional view of the body of FIG. 5 illustrating an inward angle of the ball seat bores.

FIG. 3 is a second perspective view of ball seat 100 with a body 110 having multiple ball seat bores (120A-120F) extending from a proximal face 102 to a distal face 104, as seen more readily in FIG. 8. Proximal 102 and/or distal 104 faces are not limited to being substantially flat as shown. Although six ball seat bores (120A-120F) are shown, the invention is not so limited. The number of ball seat bores (120A-120F) can depend on the diameter of balls (150A-150F) to be utilized and/or the size of the bore wherein the ball seat 100 is disposed. Further, the ball seat bores (120A-120F) are not required to be of unitary size or have the same tangential or inward angle, if angled at all. To assist in retaining a ball (150A-150F) seated therein, the ball seat bores (120A-120F) are preferably tapered along the length of the bore (120A-120F).

Figure 4:
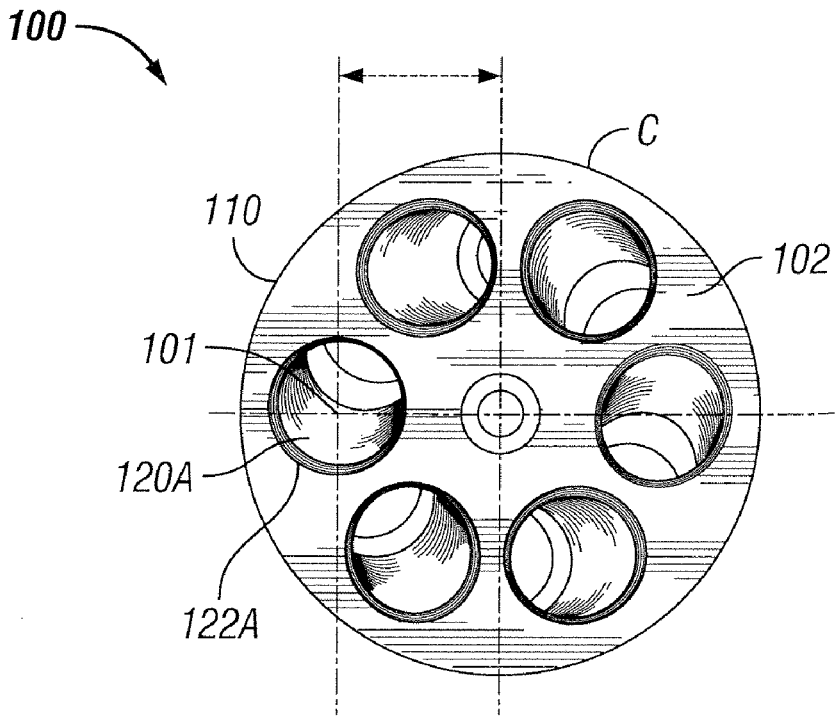
FIG. 4 is a perspective proximal end view of a body having a plurality of ball seat bores formed therein, according to one embodiment of the invention.

In some embodiments, as seen in the perspective view of FIG. 4 along the longitudinal axis of the body 110, the leading edge 122A of the ball seat bore 120A can be beveled to further aid in the insertion of a ball (150A-150F as shown in FIG. 2).

In the embodiment of the ball seat 100 illustrated in FIGS. 4-8, the ball seat bores (120A-120F) have both a tangential, or lateral, angle (L) and an inward, or radial, angle (R). As discussed above, ball seat bores (120A-120F) having only one, or neither, of the two angles (L) or (R) are included in the scope of the present invention. The term tangential angle (L) shall refer to the angular degrees, if any, of a longitudinal axis of a ball seat bore, illustrated here as longitudinal axis 121A of ball seat bore 120A in FIG. 8, measured perpendicular to said plane 101. As illustrated in FIG. 8, the tangential, or lateral, angle (L) is about 20 degrees relative the orientation of the longitudinal axis of body 110. The tangential angle (L) acts to create vorticity to prevent the dropped balls (150A-150F) from stagnating rather than seating. Accordingly, it should be understood that the angle (L) can be any angle that acts to create the desired vorticity. Embodiments of the present invention include angles (L) that range from 1-45 degrees, for example. It should be further understood that the angular direction of angle (L) is not limited to the orientation shown.

Figure 7:
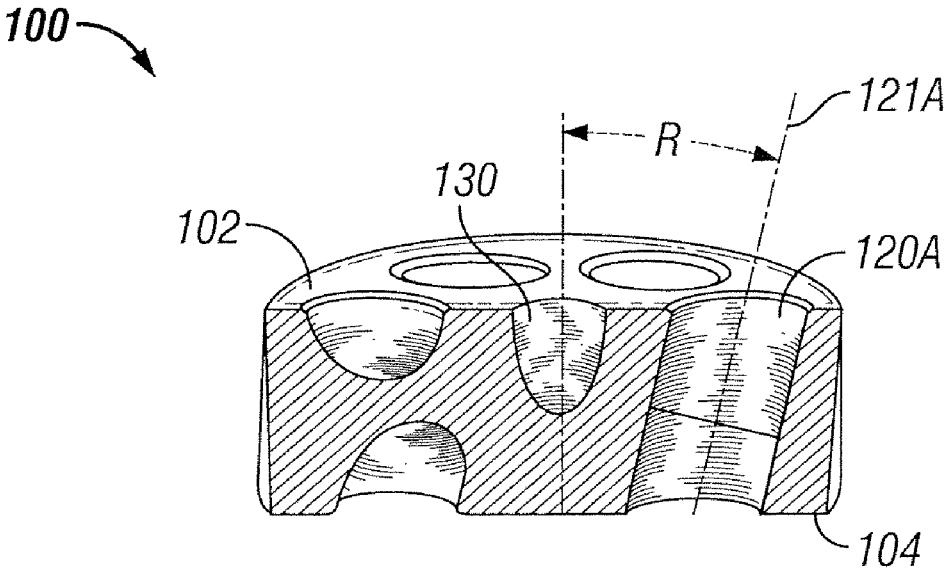
FIG. 7 is a cross-sectional view of the body of FIG. 5 illustrating a tangential angle of the ball seat bores.

The term inward, or radial, angle (R) shall refer to the degrees of angle, if any, of a longitudinal axis of a ball seat bore measured parallel to said plane (e.g., plane 101 for ball seat bore 120A). As illustrated in FIG. 7, the inward angle (R) is about 9 degrees relative the orientation of the longitudinal axis of body 110. However, depending upon the application, the inward angle (R) of embodiments of the present invention may range from 1-45 degrees, for example.

Although the angles (L) and (R) are referenced relative to the longitudinal axis of the body 110, depending on the orientation of a ball seat 100 in a ball drop apparatus, one can have at least one ball seat bore (120A-120F) with an angle (i.e., a non-parallel orientation) as compared to the direction of flow of fluid in a tubular containing said ball seat 100 (e.g., to create vorticity).

As briefly discussed above, the tangential angle (L) provides angular momentum to enable a ball to roll around a circumference of a ball seat bore (120A-120F) to aid in the seating of a ball (150A-150F). The fluid flowing through the bail seat bores (120A-120F) having a tangential angle (L) imparts an angular momentum to the fluid and thus any ball disposed in a tubular and sitting on proximal face 102 of body 110, but not yet in a ball seat bore (120A-120F). The tangential angle (L) creates fluid vorticity and can prevent the balls (150A-150F) from stagnating before being received by a ball seat bore (120A-120F). The tangential angle (L) creates angular momentum that causes a ball(s) to roll around the circumference (e.g., C in FIGS. 3-4), typically bounded by a tubular body, until the ball(s) are seated within an empty ball seat bore (120A-120F). The tangential angle (L) also assists in overcoming problems with balls (150A-150F) becoming unseated with reverse flow and/or problems with balls being difficult to re-seat.

The tangential angle (L) provides further benefit in horizontal wells. For instance, in a ball drop apparatus, a ball seat 100 is typically disposed in a tubular and the balls are displaced with a motive fluid and/or gravity. Gravity causes the balls to fall to the bottom of the pipe. This presents a well known problem in horizontal wells where the axis of the pipe is horizontal. If the ball seat bores (120A-120F) do not have a tangential angle (L), the balls (150A-150F) will remain on the low side. The tangential angle (L) creates vorticity or angular momentum in order to move the ball and allow it to seat.

The inward, or radial, angle (R) is shown as skewed inwardly towards the longitudinal axis of body 110 in FIG. 7, but can be skewed outwardly without departing from the spirit of the invention. The inward angle (R) is optional and can be chosen to maximize the wall thickness of body 110, for example, to retain a distal port of a ball seat bore (120A-120F) within the circumference (C in FIGS. 3-4) of the body 110 due to the tangential angle (L). Even though the terms lateral (L) and radial (R) are used to describe the geometrical components of the angular orientation of the ball seat bores (120A-120F), any verbiage to describe the non-parallel orientation of a ball seat bore (120A-120F) as compared to the orientation of the longitudinal axis of a body 110, for example, can be utilized.

Figure 5:
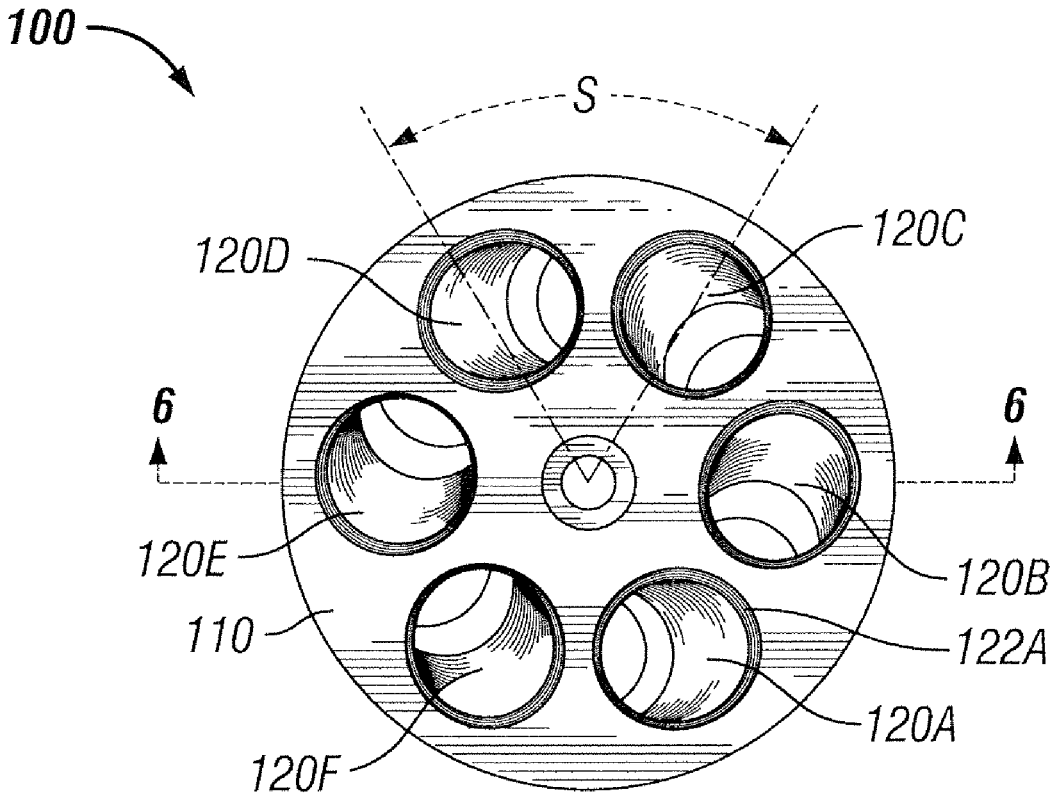
FIG. 5 is a second perspective proximal end view of a body having a plurality of ball seat bores formed therein, according to one embodiment of the invention.

FIG. 5 illustrates an equal spacing (S) of the ball seat bores (120A-120F). As the illustrated embodiment includes six ball seat bores (120A-120F), the six ball seat bores (120A-120F) are disposed at a spacing (S) of 60 degrees. It should be understood that such equal spacing (S) is not required.

Figure 6:
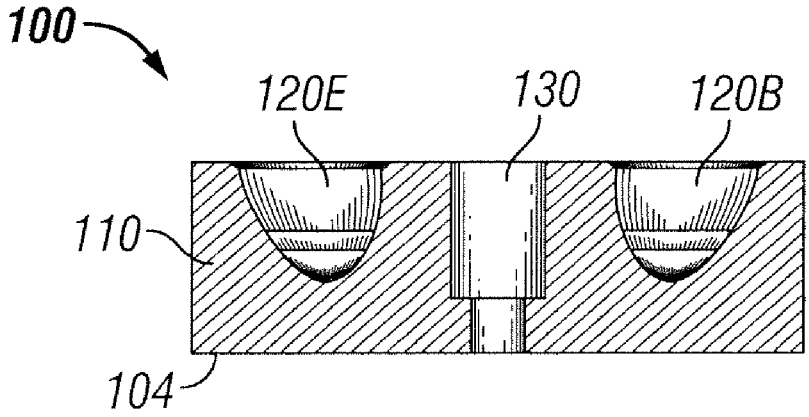
FIG. 6 is a cross-sectional view of the body of FIG. 5 along the lines 6-6.

The number, diameter, and/or spacing (S) of ball seat bores (120A-120F) can be selected for any purpose. One non-limiting example is to maximize the flow of fluid through body 110 and thus minimize the erosion experienced on body 110. Longitudinal passage 130 is not limited to having a shoulder formed therein as seen in FIG. 6, and can be of uniform diameter if desired.

Ball seat bores (120A-120F) can include a taper to form the ball seating surface, or a separate ball seating surface (not shown) can be disposed therein without departing from the spirit of the invention. As shown in FIG. 8, a ball seat bore 120A has a tapered section 160A and a non-tapered (e.g., uniform diameter) section 160B therein, however the entire length of a ball seat bore 120A can be tapered without departing from the spirit of the invention. Tapered section 160A has a taper (T) of about 3 degrees and thus an included angle of about 6 degrees. Any included angle can be utilized, for example, but not limited to, an included angle between about 1 to about 30 degrees. A ball seat bore (120A-120F) and ball (150A-150F) are preferably selected so that a proximal portion of the ball (150A-150F) is substantially even with a proximal end of a ball seat bore (120A-120F) when seated therein, as illustrated in FIG. 2.

Figure 11:
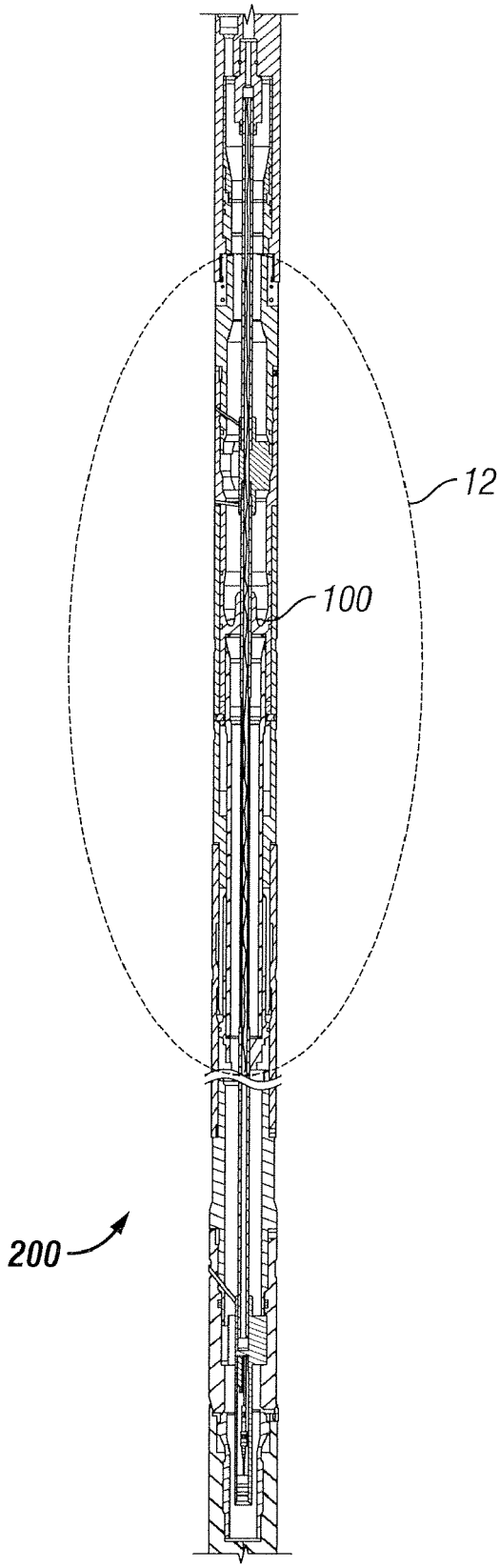
FIG. 11 is a cross-sectional view of a coiled tubing disconnect including a plurality of ball seat bores in a ball seat body therein, according to one embodiment of the invention.
Figure 12:
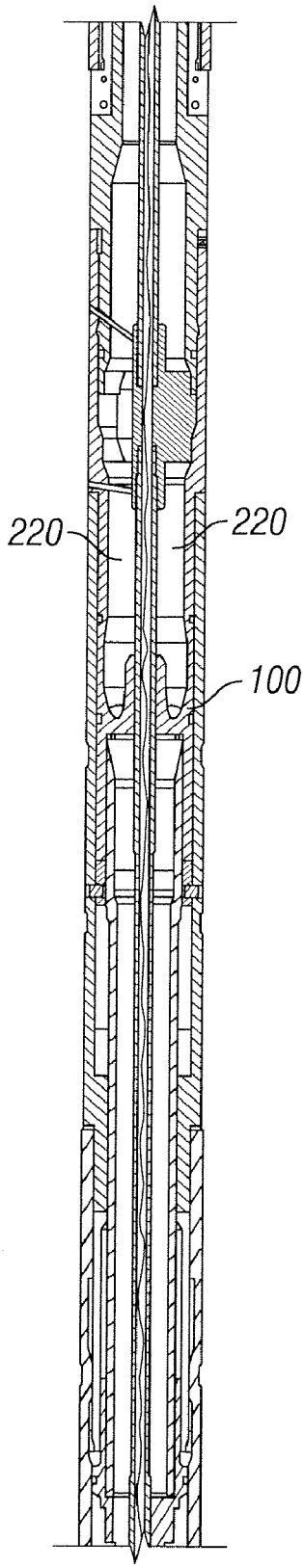
FIG. 12 is a close-up cross-sectional view of the coiled tubing disconnect of FIG. 11, as marked with a 12.

FIG. 11 is a coiled tubing disconnect 200, utilizing ball seat 100, or more particularly, a ball seat 100 having a plurality of ball seat bores (120A-120F). FIG. 12 is close-up cross-sectional view of the portion of coiled tubing disconnect marked with a 12 in FIG. 11. In use, the coiled tubing disconnect 200 is connected to a string of coiled tubing (not shown). When disconnection is desired, a plurality of balls (150A-150F) can be pumped into the bore of the string of coiled tubing. With a ball seat 100 having six ball seat bores (120A-120F), at least six balls (150A-150F), but as many as desired, are disposed into the bore of coiled tubing and further disposed into the bore 220 of the coiled tubing disconnect 200. The force of the fluid flowing and/or gravity disposes the balls (150A-150F) into the ball seat bores (120A-120F). The tangential angle (L) creates vorticity in the area adjacent the proximal (e.g., entry) face 102 of the ball seat 100, and thus aids in the insertion of a ball (150A-150F) into any ball seat bore (120A-120F) not containing a ball. Thus any unseated balls can roll around the circumference (C) of the body 110 until seated. Pressure can then be increased as the ball seat 100 is substantially sealed (i.e., by balls 150A-150F seated in ball seat bores 120A-120F) until the coiled tubing disconnect is actuated, as is known in the art. The ball seat 100 can also include one or more longitudinal passages 130, for example, to allow a wireline cable, hydraulic line, communication line such as optical fiber, or other continuous conduit to extend therethrough. The use of multiple balls (150A-150F) and ball seat bores (120A-120F), instead of a single ball seat bore in a ball seat as is common in the art, allows a conduit or cable to be disposed through a tubular housing said ball seat 100, and thus through ball seat 100. The number and orientation of multiple ball seat bores (120A-120F) can be designed to retain a high flow rate across the ball seat 100.

A ball seat 100 for the reception of multiple balls as disclosed in the coiled tubing disconnect 200 can be combined with a multiple ball circulation valve disposed above (e.g., downstream) or preferably below (e.g., upstream) ball seat 100 without departing from the spirit of the invention. Although the use of a ball seat 100 is described in reference to the coiled tubing disconnect 200 shown in FIGS. 11 and 12, a single ball seat bore (120A-120F) can be utilized in a ball seat of any ball drop apparatus without departing from the spirit of the invention. The ball set 100 of the present invention can be used with downhole tools and components such as an inflatable packer; a circulation valve for opening ports to the annulus; a drilling connector, for example, as disclosed in U.S. Pat. No. 5,417,291; an impacting or jarring tool, for example, as disclosed in U.S. Pat. Nos. 6,571,870 and 6,907,927; or a reversing valve, for example, as disclosed in U.S. Pat. No. 6,571,870, all incorporated by reference herein.

In one embodiment, the diameter of all balls (150A-150F) received by a ball seat 100 are of the same diameter. Similarly, the portion of all the ball seat bores (120A-120F) that retains (e.g., forms a seat for) a ball is of the same diameter. A multiple-ball seat 100 suffers minimal erosion due to pumped sand laden fluid, is tolerant to repeated shock loading from a perforating operation, for example, and can be compatible with wireline run inside a coiled tubing. Internal bore of coiled tubing, or any body containing ball seat 100, can have a weld flash partially removed.

Numerous embodiments and alternatives thereof have been disclosed. While the above disclosure includes the best mode belief in carrying out the invention as contemplated by the named inventor, not all possible alternatives have been disclosed. For that reason, the scope and limitation of the present invention is not to be restricted to the above disclosure, but is instead to be defined and construed by the appended claims.

What is claimed is:

1. A ball seat of a ball drop apparatus to actuate a downhole component, comprising:

a plurality of ball seat bores extending therethrough; and at least one passage extending therethrough, wherein at least one of the ball seat bores is adapted to seat and retain at least one ball introduced into a wellbore tubular after the ball seat is deployed in the wellbore tubular, the plurality of ball seat bores shaped to impart annular momentum to fluid passing therethrough, the ball seat bores shaped such that they are tangentially angled.

2. The ball seat of claim 1 wherein at least one of the ball seat bores is tapered to seat at least one ball therein.

3. The ball seat of claim 1, wherein the ball seat bores are further shaped such that they have a radial angle.

4. The ball seat of claim 1 wherein the tangential angle ranges from about 1-45 degrees.

5. The ball seat of claim 3 wherein the radial angle ranges from about 1-45 degrees.

6. The ball seat of claim 1, wherein the at least one passage is adapted for receipt of a communication line.

7. The ball seat of claim 1, wherein the at least one passage is adapted for receipt of wireline or slickline.

8. A method of actuating a downhole component with a ball drop apparatus comprising:

conveying the ball drop apparatus in a wellbore tubular, the ball drop apparatus comprising a body with at least one ball seat bore extending therethrough and at least one passageway extending therethrough;

introducing at least one ball into the ball drop apparatus after the conveying;

providing a fluid to the body to seat the at least one ball into the ball drop apparatus, wherein the at least one ball seat bore is angled with respect to the body such that annular motion is imparted to the fluid and wherein the at least one ball seat bore is tangentially angled; and seating and retaining the at least one ball into the at least one ball seat bore to actuate the downhole component.

9. The method of claim 8 wherein the at least one ball seat bore is tapered.

10. The method of claim 8, further comprising providing a fluid to the body at a pressure sufficient to actuate the downhole component when the at least one ball is seated in the at least one ball seat bore.

11. The method of claim 8, wherein the at least one ball seat bore further has a radial angle.

12. The method of claim 8, wherein the ball drop apparatus is conveyed on coiled tubing.

13. The method of claim 8, further comprising conveying a communication line therethrough the at least one passageway.

14. The method of claim 8, further comprising conveying a wireline through the at least one passageway.

15. The method of claim 8, further comprising conveying a wireline tool through the at least one passageway.

* * * * *

UNITED STATES PATENT AND TRADEMARK OFFICE

CERTIFICATE OF CORRECTION

PATENT NO. : 7,640,991 B2
APPLICATION NO. : 11/469303
DATED : January 5, 2010
INVENTOR(S) : Lawrence J. Leising It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 258 days.

Signed and Sealed this

Sixteenth Day of November, 2010

David J. Kappos

David J. Kappos
*Director of the United States Patent and Trademark Office*